United States Patent [19]

Wilson, Jr.

[11] Patent Number: 4,716,847

[45] Date of Patent: Jan. 5, 1988

[54] MULTIPLE-HULLED MARINE VESSEL

[76] Inventor: Earl B. Wilson, Jr., 20655 Bowery La., Bend, Oreg. 97701

[21] Appl. No.: 931,934

[22] Filed: Nov. 17, 1986

Related U.S. Application Data

[63] Continuation of Ser. No. 763,667, Aug. 8, 1985, abandoned.

[51] Int. Cl.[4] ..... B63B 35/52

[52] U.S. Cl. ..... 114/61; 114/279; 248/284

[58] Field of Search ..... 114/279, 61, 264, 266, 114/267; 188/20 R; 248/640, 642, 284, 291

[56] References Cited

U.S. PATENT DOCUMENTS

| | | | |
|---|---|---|---|
| 996,444 | 6/1911 | Yarrington | 114/61 |
| 1,738,979 | 12/1929 | Adelmann | 114/61 |
| 2,930,338 | 3/1960 | Flomenhaft | 114/279 |
| 3,075,490 | 1/1963 | Lang | 114/279 |
| 3,326,166 | 6/1967 | Yost | 114/66.5 |
| 3,345,967 | 10/1967 | Sweet | 114/61 |
| 3,401,663 | 9/1968 | Yost | 114/66.5 |
| 3,528,380 | 9/1970 | Yost | 114/66.5 |
| 3,635,035 | 1/1972 | Greer | 114/279 |
| 3,763,811 | 10/1973 | Danahy | 114/279 |
| 3,860,982 | 1/1975 | Rumsey | 114/279 |
| 3,908,577 | 7/1975 | Struyk | 114/61 |
| 3,933,110 | 1/1976 | Jamieson | 114/61 |
| 4,024,592 | 5/1977 | Schlagenhauf | 114/61 |
| 4,295,236 | 10/1981 | Upchurch | 114/61 |
| 4,543,898 | 10/1985 | Castilla | 114/61 |

*Primary Examiner*—Joseph F. Peters, Jr.
*Assistant Examiner*—Clifford T. Bartz
*Attorney, Agent, or Firm*—Merrill N. Johnson

[57] ABSTRACT

A multiple-hulled marine vessel resistant to forces tending to separate the hulls from the platform is provided. The connections between the hulls and the platform include elastic elements which are in a non-tensioned state when the hulls are touching the platform, and are compressed when the hulls separate from the platform.

4 Claims, 14 Drawing Figures

MULTIPLE-HULLED MARINE VESSEL

This is a continuation of co-pending application Ser. No. 763,667 filed on Aug. 8, 1985, now abandoned.

BACKGROUND OF THE INVENTION

This invention relates to a multiple-hulled marine vessel and means for interconnecting the components thereof, and particularly to a catamaran having means to increase the resistance to forces tending to separate the hulls of the catamaran from the cabin.

Multiple-hulled marine vessels—i.e., catamarans, trimarans, etc., whether motor-driven or sail-driven, are popular because of their stability. For a given set of characteristics—e.g., interior space, sail area, etc., a catamaran or other multiple-hulled vessel is generally more difficult to capsize than a single-hulled vessel having the same characteristics.

However, multiple-hulled vessels (hereinafter "catamarans" regardless of the number of hulls) have a structural disadvantage over single-hulled vessels. Because they include several structural elements, including the hulls and a platform which may bear the cabin, they are subject to breaking up in rough seas, both from the action of large waves on the underside of the platform, and from the action of waves on the hulls producing horizontal shear forces and longitudinal and transverse torques. All of these forces tend to separate the platform from the hulls.

Heretofore, catamarans have been heavily braced between the hulls in order to overcome this tendency. However, such bracing results in a much heavier and more expensive craft. An alternative solution which has been used to reduce the effect of waves on the underside of the platform is to eliminate the platform in whole or in part, moving some or all of the cabin area into the hulls, thereby reducing the surface area on which destructive waves can act. However, this alternative still requires bracing. It does not deal with the horizontal shear forces or the longitudinal and transverse torques caused by wave action on the hulls. It also has the additional disadvantage of reducing the liveability of the vessel by at best separating the living area onto different levels, if some platform is retained, or at worst, if no platform is retained, separating the living area into separate sections between which movement is extremely limited if at all possible.

It would be desirable to provide a catamaran which resists forces tending to separate the cabin platform from the hulls without heavy or expensive bracing or reduced liveability.

SUMMARY OF THE INVENTION

It is an object of this invention to provide a catamaran with increased resistance to forces tending to separate its components.

It is another object of this invention to provide such a catamaran which does not have heavy bracing.

It is a further object of this invention to provide such a catamaran which permits having the cabin on one level.

In accordance with this invention, a multiple-hulled vessel is provided having a cabin platform, a hull having a longitudinal axis, and elastic means for connecting the platform and the hull. The elastic connecting means is in a non-tensioned state when the platform and the hull are in their nominal positions with no abnormal wave forces being exerted on the vessel, and is compressed in response to forces tending to separate the platform from the hull.

Preferably, the vessel has two hulls and the platform has a floor and a plurality of flanged beams, having upper and lower flanges, running beneath the floor. At least some of the beams have openings in their lower flanges. The two hulls are spaced apart along a direction perpendicular to their longitudinal axes, and have openings corresponding to the openings in the flanges of the beams. A stout bolt passes through each pair of corresponding openings in the flanges and the hulls, with its head within the hull. A coil spring is associated with each stout bolt. One end of the spring is fastened to the end of the stout bolt remote from the head, and the other end rests against the respective lower flange with which it is associated. The coil springs are in their non-tensioned state when the hulls are in their nominal positions in contact with the flanges. The coil springs are compressed in response to forces tending to separate the hulls from the flanges.

Preferably, at least one projection depends from at least one lower flange toward one of the hulls. That hull has a corresponding recess at least as large as the projection for receiving the projection. The projections engage the recesses to prevent substantial horizontal relative displacement between the hulls and the platform. In addition, at least one leverage element may extend from each hull toward the other and contact the lower flange. The leverage elements increase the force necessary to compress the springs.

BRIEF DESCRIPTION OF THE DRAWINGS

The above and other objects and advantages of the invention will be apparent after consideration of the following detailed description, taken in conjunction with the accompanying drawings, in which like reference characters refer to like parts throughout, and in which.

DETAILED DESCRIPTION OF THE INVENTION

A vessel embodying the present invention can be used for cruising in any type of waters. The present invention assures that heavy waves will not cause the hulls of the vessel to separate from the cabin.

Figure 1:
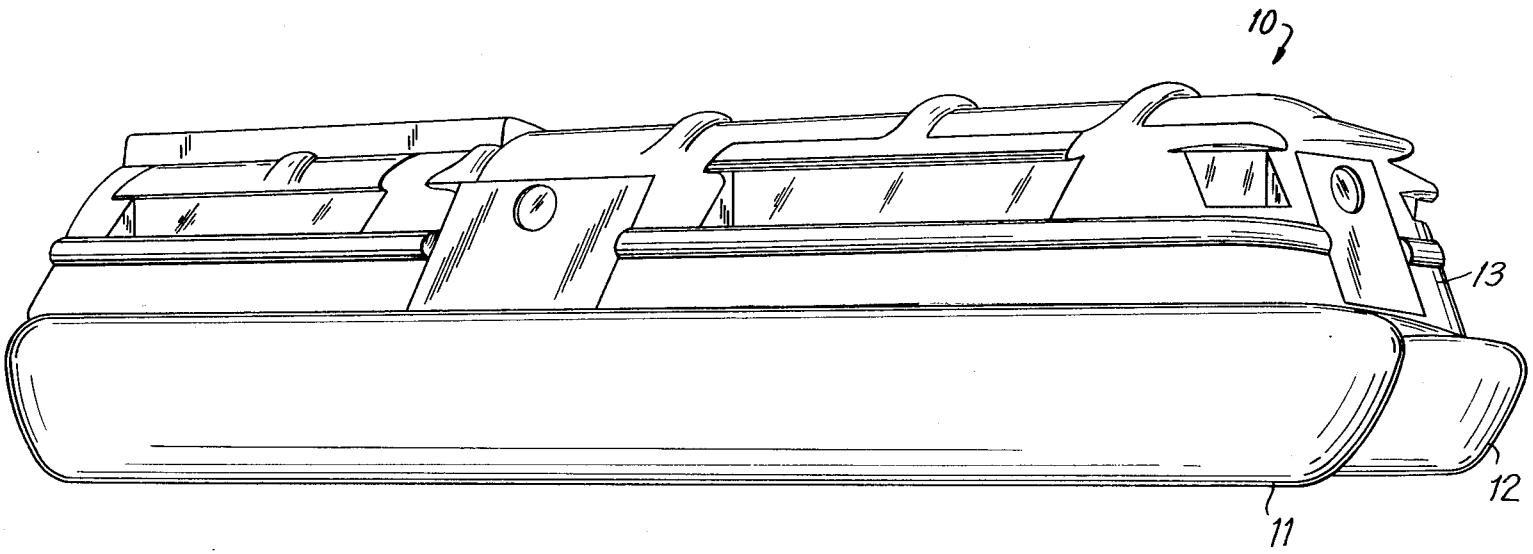
FIG. 1 is a front starboard perspective view of a vessel embodying the present invention.
Figure 2:
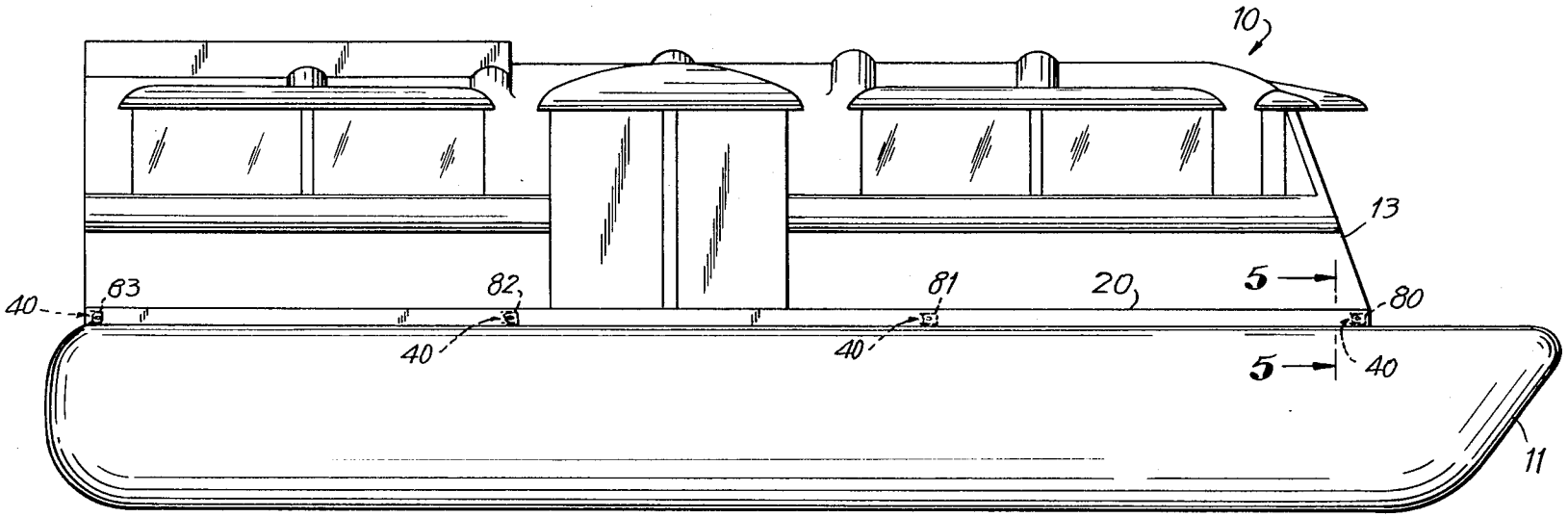
FIG. 2 is a starboard elevational view of the vessel of FIG. 1.
Figure 3:
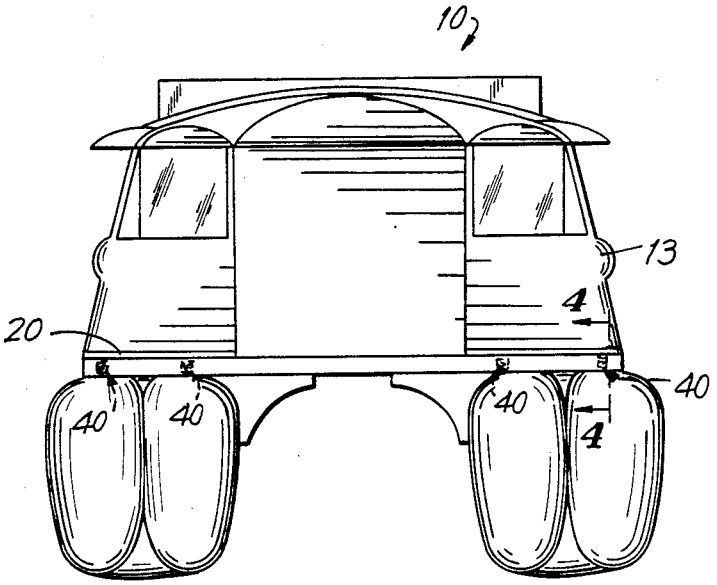
FIG. 3 is a bow elevational view of the vessel of FIGS. 1 and 2.

A preferred embodiment of the type of vessel in which the present invention can be employed is shown in FIGS. 1–3. Catamaran 10 has two hulls 11, 12 which support a cabin 13. Cabin 13 rests on a platform 20, which in turn rests on crossbeams 80–83, best seen in FIG. 8. Although four crossbeams are shown, any suitable number may be used consistent with this invention. Platform 20 is preferably made of hollow decking with lengthwise or crosswise vertical support strips inside. It also can be made of any number of other materials, including laminations of cored foam with glass-fiber reinforced plastic surfaces or layers of heavy-duty marine plywood, which are epoxied, bolted and nailed together. Cabin 13 is preferably of lightweight construction, furnished inside with built-in motorhome-style furniture and facilities, but can be of various interior designs. Hulls 11, 12 and crossbeams 80–83 are preferably made of glass-fiber reinforced plastic.

Figure 4:
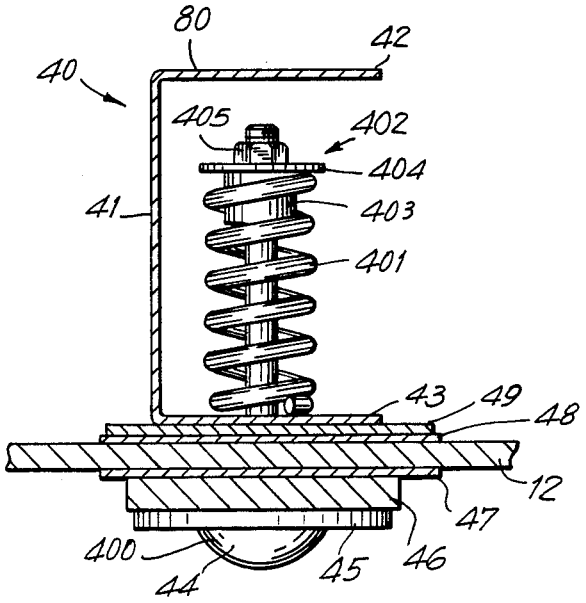
FIG. 4 is a cross-sectional view of the connection between the hull and the platform of the vessel of FIGS. 1–3, taken from line 4—4 of FIG. 3.
Figure 5:
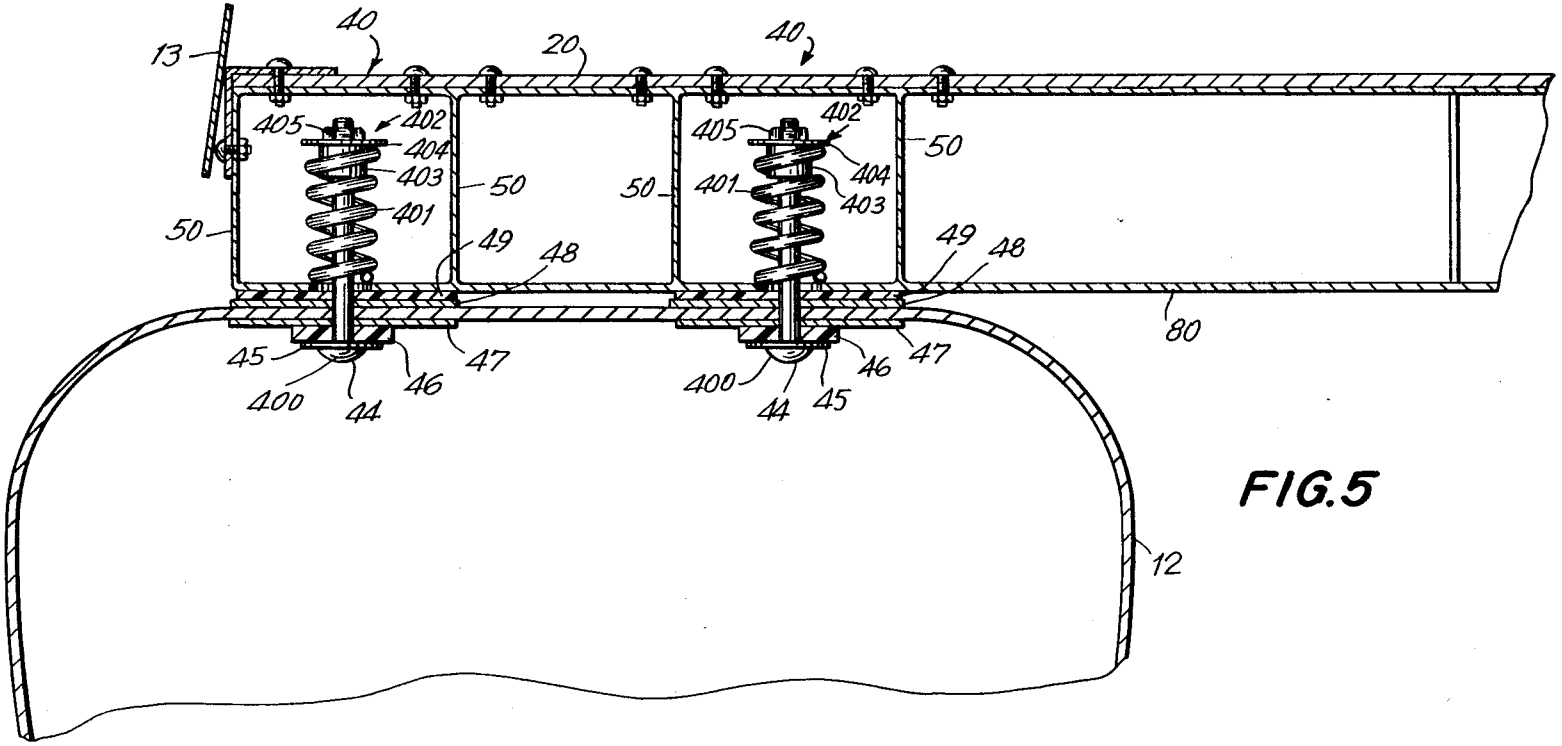
FIG. 5 is an elevational view, partly in section, of the connection between the hull and the platform of the vessel of FIGS. 1–3, taken from line 5—5 of FIG. 2.
Figure 5A:
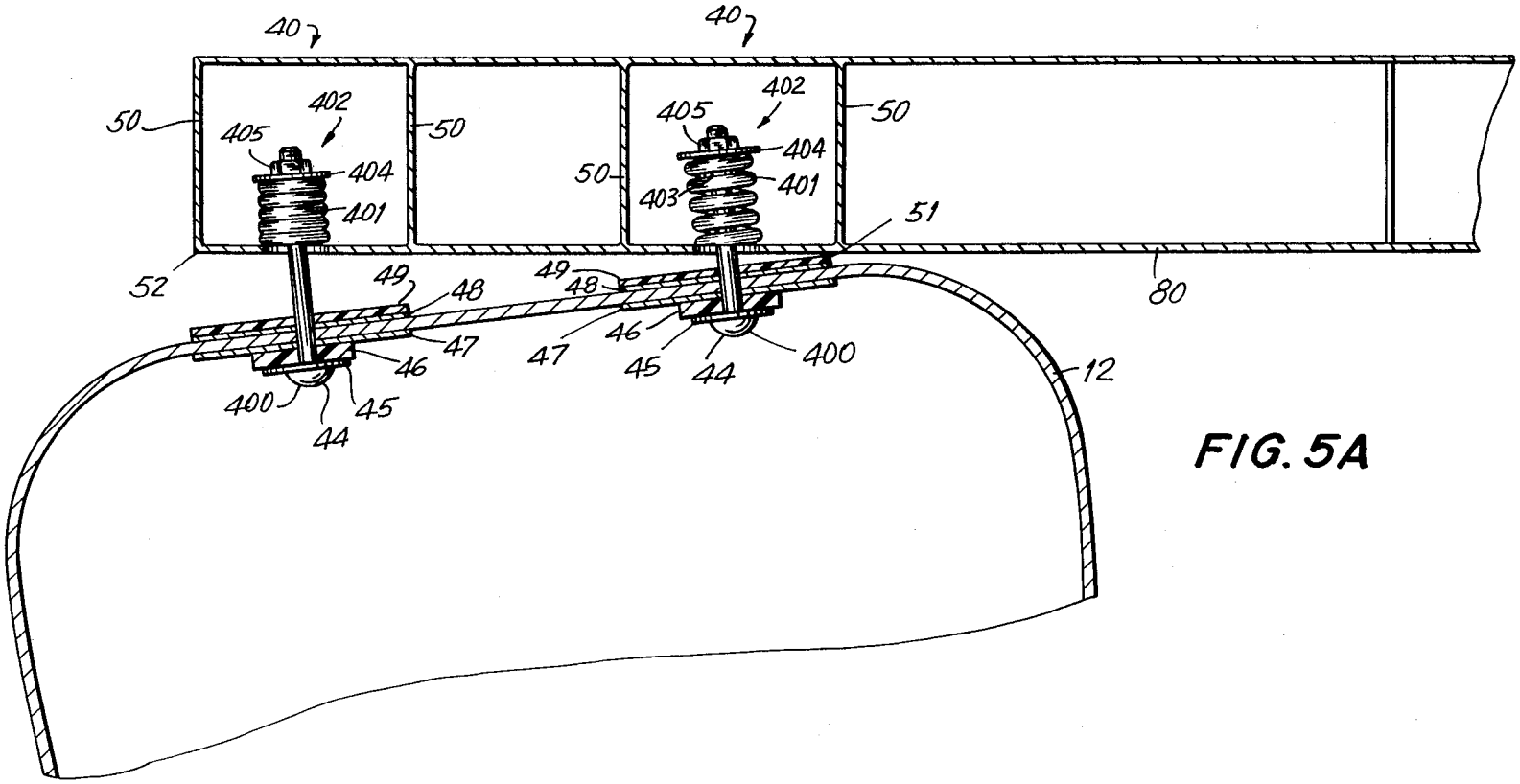
FIG. 5A is an elevational view, partly in section, of the connection of FIG. 5 with the springs in their compressed condition.

Crossbeams 80–83 are attached to hulls 11, 12 by elastic connections 40, shown in detail for hull 12 in FIGS. 4–5A. The connections for hull 11 are identical and operate in the same way. As seen in FIG. 4, crossbeam 80 is preferably C-shaped, having a vertical web 41 and two horizontal flanges 42, 43 extending from the top and bottom edges of web 41. Flanges 42, 43 preferably extend rearwardly, so that web 41 presents a smooth face to waves, minimizing resistance. A post, preferably a stout bolt 44, passes upward through a washer 45, a rubber or other elastic cushion 46, a steel plate 47, hull 12, another steel plate 48, a thin elastic mat 49, and lower flange 43 of crossbeam 80, with a head 400 within hull 12. One end of a coil spring 401, similar to that used in automotive suspension systems, is fixed to the other end of bolt 44, and extends back toward head 400, such that bolt 44 passes vertically through the center of spring 401. The other end of spring 401 rests on lower flange 43. Spring 401 is fixed to bolt 44 by the use of a spring holder 402. Spring holder 402 consists of a length of pipe 403, having an outer diameter equal to or slightly less than the inner diameter of spring 401 and a length sufficient for at least one turn of spring 401 to be wrapped around it, to which is welded a circular plate 404 of diameter greater than the outer diameter of spring 401. The entire assembly is screwed down against spring 401 by nut 405. Preferably, there are two connections 40, as shown in FIG. 5, connecting each hull 11, 12 to each crossbeam. However, any number may be used, including a single connector 40. Crossbeam 80 can have gussets 50 on either side of each connection for the purpose of strengthening the beam.

When hulls 11, 12 and crossbeam 80 are in their nominal relative positions—i.e., when the hulls and the crossbeam are in direct contact, which occurs in calm waters or when vessel 10 is on land, springs 401 are in their non-tensioned condition. As used herein and in the claims which follow, "non-tensioned" means that the spring is either in a completely neutral or relaxed state, or a state of initial compression, but does not include a state of tension. As a practical matter, when spring holder 402 is bolted down with nut 405, some compression of spring 401 occurs. When using automobiletype springs in the preferred embodiment, spring holder 402 may be bolted down to a force of about 500 pounds or more, depending on the size and type of vessel. This initial compression can serve as a restoring force of that magnitude which resists the separation of the hulls from the crossbeam by forces of smaller magnitude.

A craft such as vessel 10 is intended for leisurely cruising. It is unlikely that it would achieve speeds great enough to cause planing of hulls 11, 12 on the surface of the water, which would subject the hulls to upward forces as waves strike the bottoms of the hulls. Therefore connections 40 are not constructed to absorb such impacts, which, should they occur, are transmitted directly to the crossbeams 80–83, and thence to platform 20 and cabin 13. Connections 40 respond instead to forces tending to separate platform 20 and cabin 13 from hulls 11, 12.

Connections 40 resist the torques caused by the buffeting of vessel 10 by strong waves, and any vertical forces that may be caused by the torques, both of which tend to pull the hulls from the platform. Under such conditions, hulls 11, 12 can be subjected to longitudinal torsional stresses and transverse torsional stresses. The forces of the waves also cause torsional stresses—primarily transverse torsional stresses—on the hulls themselves. One of the most destructive conditions occurs when the hulls are rocking forward and backward in opposite directions, that is, the bow of one hull is being forced up while the bow of the other is being forced down, with the respective sterns being forced correspondingly down and up. The effect of this motion on the cabin platform is that one pair of diagonally opposite corners of the platform is going upward, while the other pair is going downward, exerting a combination of longitudinal and transverse torques on the cabin and platform. If not compensated for, these stresses can force the hulls from the crossbeams or wreck the cabin or the hulls.

FIG. 5A shows how connections 40 resist the destructive effects of torque on hull 12. A counterclockwise torque (for the purposes of illustration, a pure longitudinal torque is shown) has caused hull 12 to pivot about point 51. The leftmost of the two connections 40 shown, which is further from point 51, absorbs most of the force tending to separate hull 12 from crossbeam 80. As depicted, spring 401 of the left connection 40 is fully compressed. Some of the force is also absorbed by the right connection 40, which is close to pivot point 51, but its spring 401 is only partially compressed. Cushion 46 also may assist in absorbing force. The torque shown in FIG. 5A is a relatively large torque shown for purposes of illustration. Seas rough enough to cause such a torque would be exceptional and the vessel is intended to sail in waters in which such seas should not be encountered. In the case of a clockwise longitudinal torque, the hull will pivot about point 52, and the rightmost spring 401 would compress more than the leftmost spring 401. The condition depicted in FIG. 5A can also be caused by wave buffeting and subsurface backwash, or by a combination of forces.

Figure 8:
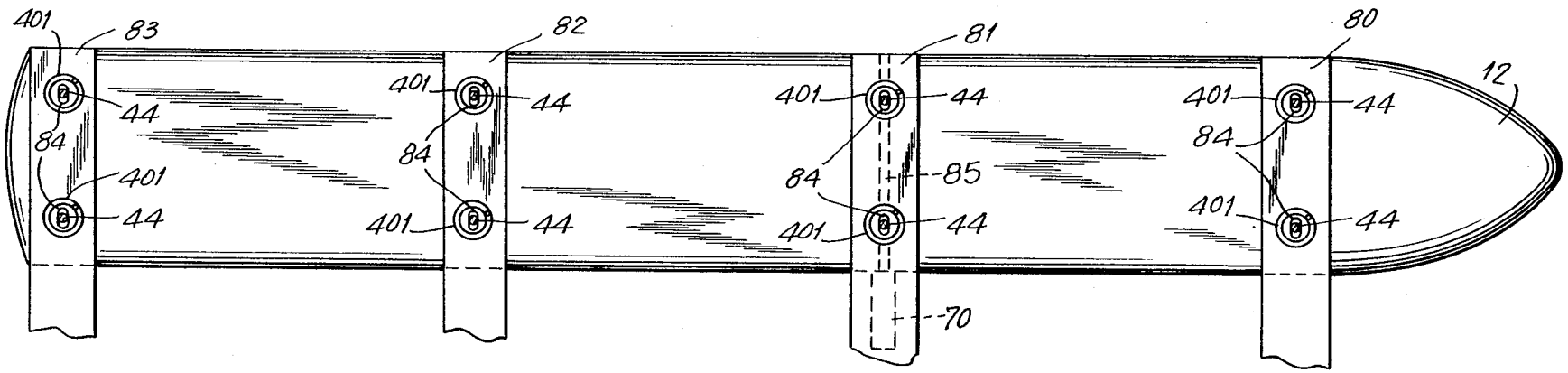
FIG. 8 is a plan view of the connection of FIG. 7, taken from line 8—8 of FIG. 7.

As can be seen in FIG. 5A, bolt 44, which is nominally vertical, may tilt as the hull pivots. To accommodate this motion, hole 84 in lower flange 43 though which bolt 44 passes is slightly elongated in the transverse direction, as shown in FIG. 8, to prevent damage to the flange. The length of hole 84 is preferably at least twice the diameter of bolt 44, so that the clearance on either side of bolt 44 is at least one-half the bolt diameter when bolt 44 is in its nominal position.

Steel plates 47, 48, cushions 46, 49 and washer 45 are provided to protect hulls 11, 12 around the point through which bolt 44 passes. In the absence of washer 45, cushion 46, and plate 47, heads 400 of bolts 44 would dig into and eventually wear through hulls 11, 12, especially when bolt 44 tilts, and particularly if hulls 11, 12 are made of glass-fiber reinforced plastic. Similarly, plate 48 and cushion 49 prevent crossbeams 80–83 and hulls 11, 12 from wearing each other down as they pivot and slide relative to one another. Plates 47 and 48 can be similar to washers and can be used adjacent each connection 40, and preferably are rectangular plates directly under and slightly wider than each crossbeam 80–83.

In the case of a pure transverse torque, the two connections 40 associated with the crossbeam furthest from the point, usually the center point, about which hull 12 pivots would compress the most, while those associated with the crossbeam closest to the pivot point would compress the least, with both connections 40 associated with each particular crossbeam 80, 81, 82, or 83 being compressed the same amount. This condition is not illustrated. However, because of the length of hull 12, there would not be any significant tilt of bolts 44. Therefore, holes 84 are not elongated in the longitudinal direction.

As discussed above, in practice vessel 10 will be subject to a combination of transverse and longitudinal torques. Under such conditions, the reaction of the connections 40 will be a combination of the modes described in connection with FIG. 5A and in the preceding paragraph.

There is an additional possible mode of operation of the connector system. It is possible that a pure vertical force will act to separate the hull from the crossbeams. This might occur if an unusual wave delivers a very sharp, sudden impulse to the underside of platform 20. In such a case (not shown), all springs 401 would be compressed to the same degree and all bolts 44 would remain vertical. Washer 45, cushion 46 and plate 47 protect the underside of the top of the hull from the upward force of bolt head 400 under such conditions.

Figure 6:
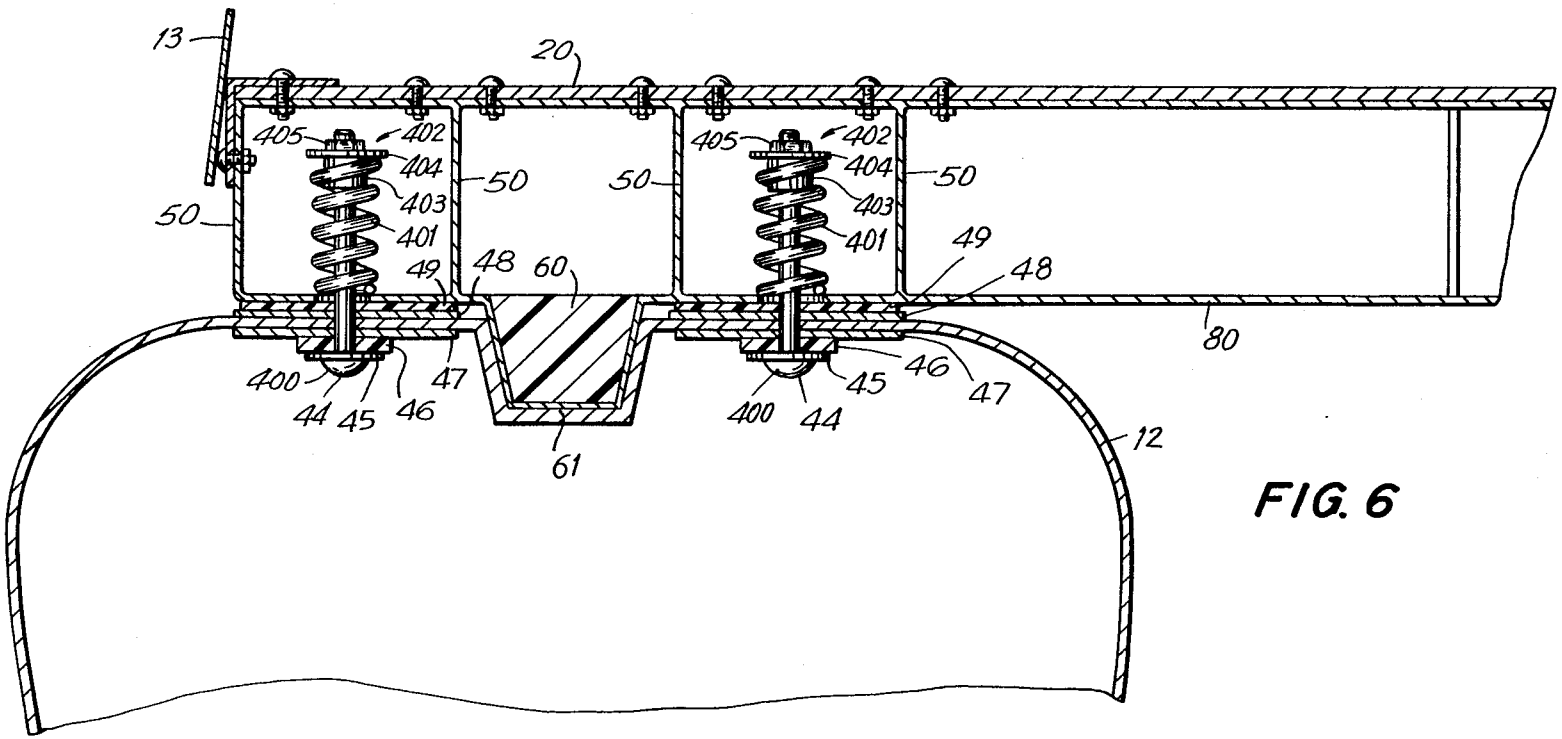
FIG. 6 is an elevational view, partly in section, of an alternative embodiment of the connection of FIG. 5.

Hulls 11, 12 may be subjected to pure horizontal transverse forces. These forces would tend to cause hulls 11, 12 to move transversely relative to crossbeams 80–83. Although springs 401 are capable of absorbing small amounts of forces in the horizontal direction, bolts 44 would quickly reach the edges of elongated holes 84, subjecting them to the possibility of being sheared off. To avoid this possibility, there is provided, as shown in FIG. 6, a projection 60 which preferably is integrally molded with crossbeam 80, depending vertically from the underside of lower flange 43. Projection 60 is tapered on all four sides (front and back sides not shown), so that it resembles a gear or cog tooth. A recess 61 is provided in hull 12 with a corresponding shape. The engagement of projection 60 with recess 61 prevents horizontal relative displacement between hull 12 and crossbeam 80. The height of projection 60 should exceed the difference in the length of spring 401 between its fully extended and fully compressed positions, so that it can never clear the edge of recess 61. If desired, recess 61 can be made wider than projection 60 by an amount no greater than the amount by which the length of elongated holes 84 exceeds the diameter of bolts 44. This would allow some horizontal relative displacement, but would not let bolts 44 reach the edges of holes 84.

Figure 6A:
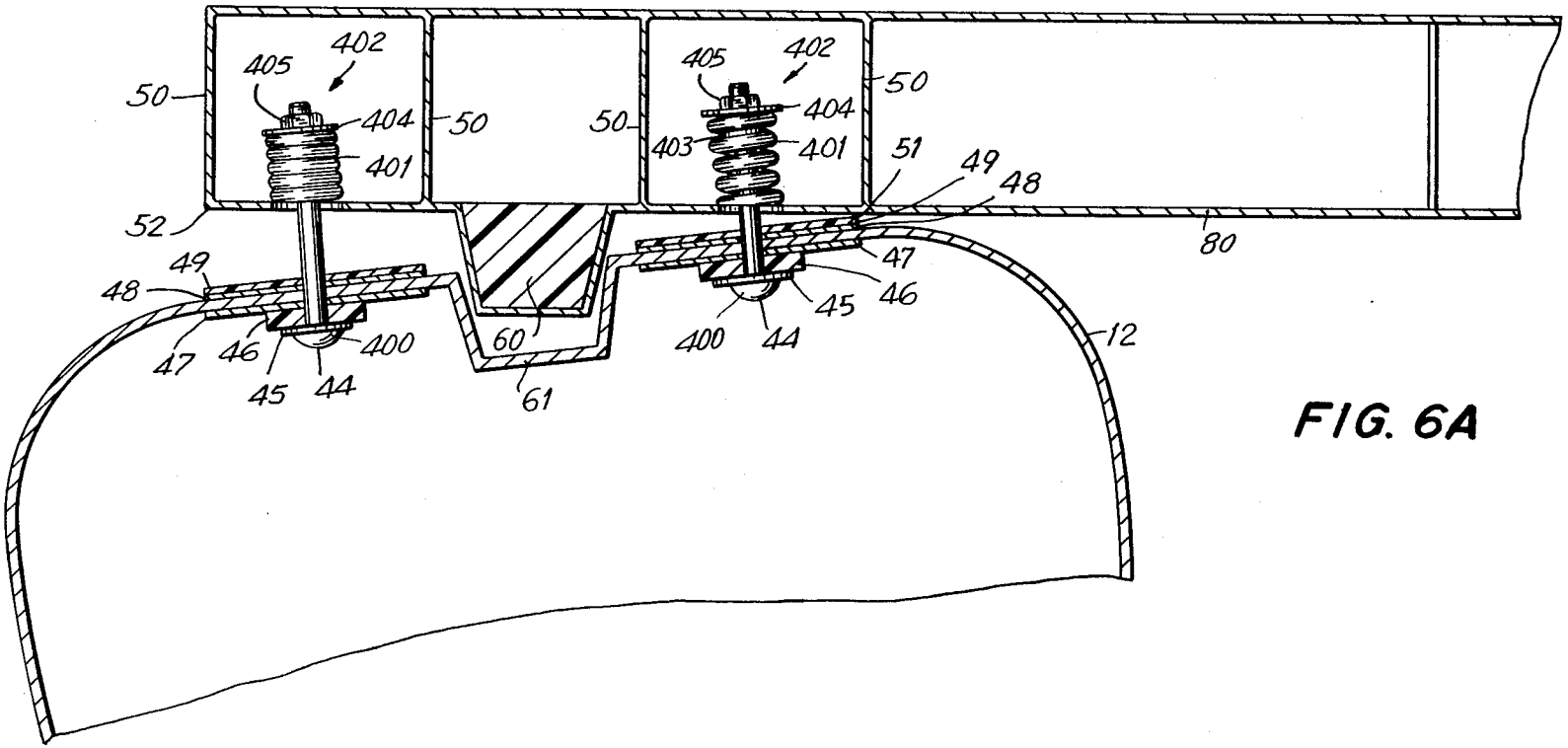
FIG. 6A is an elevational view, partly in section, of the connection of FIG. 6 with the springs in their compressed condition.

Horizontal force is thus absorbed by projection 60 and recess 61, rather than by bolts 44. The inclined sides of projection 60 and recess 61 allow, as shown in FIG. 6A, the kind of motion described in connection with FIG. 5A. The inclined sides may also convert some portion of a pure horizontal force into a torque, again creating the kind of motion shown in FIG. 6A and dissipating a portion of the horizontal force. It is understood, of course, that the condition shown in FIG. 6A could be caused by a torque similar to the one which causes the condition shown in FIG. 5A, and the addition of projection 60 to form the embodiment of FIG. 6 has no effect on the response of connections 40 to such a torque.

The stiffness of springs 401 is determined by the magnitude of the forces expected to be encountered. Springs 401 should not be so weak that relatively small forces compress them completely. If they were, the damping effect of springs 401 would be completely overcome by small waves, leaving vessel 10 subject to damage by larger waves. On the other hand, if springs 401 are too stiff, vessel 10 will have to absorb some relatively large, potentially damaging forces before springs 401 begin to react. The stiffness of springs 401 therefore depends on the desired characteristics of vessel 10.

For a given spring 401 in the leftmost position in FIGS. 5–6A, the maximum force that can act on hull 12 before spring 401 is overwhelmed and can no longer be compressed can be increased through addition of a leverage element to the hull.

Figure 7:
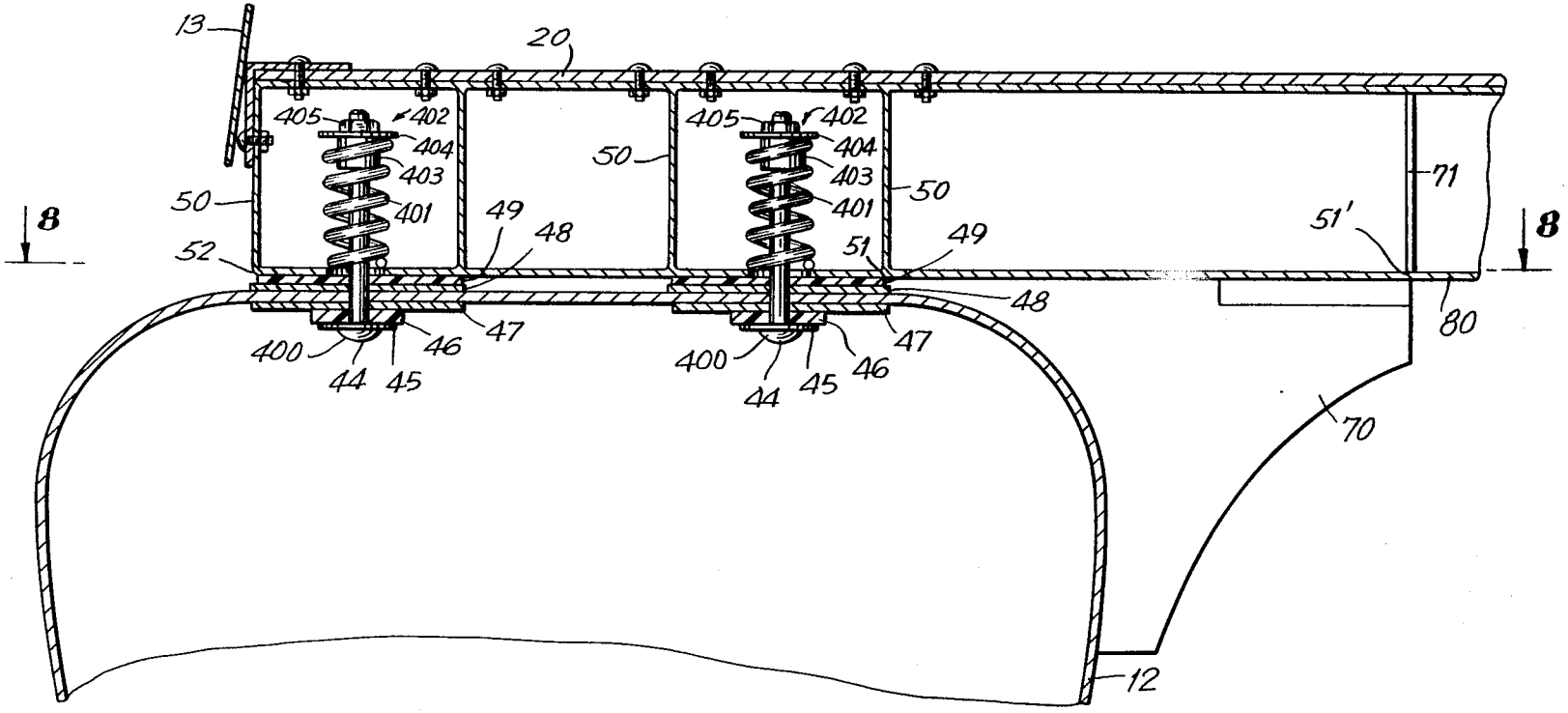
FIG. 7 is an elevational view, partly in section, of a second alternative embodiment of the connection of FIG. 5.
Figure 7A:
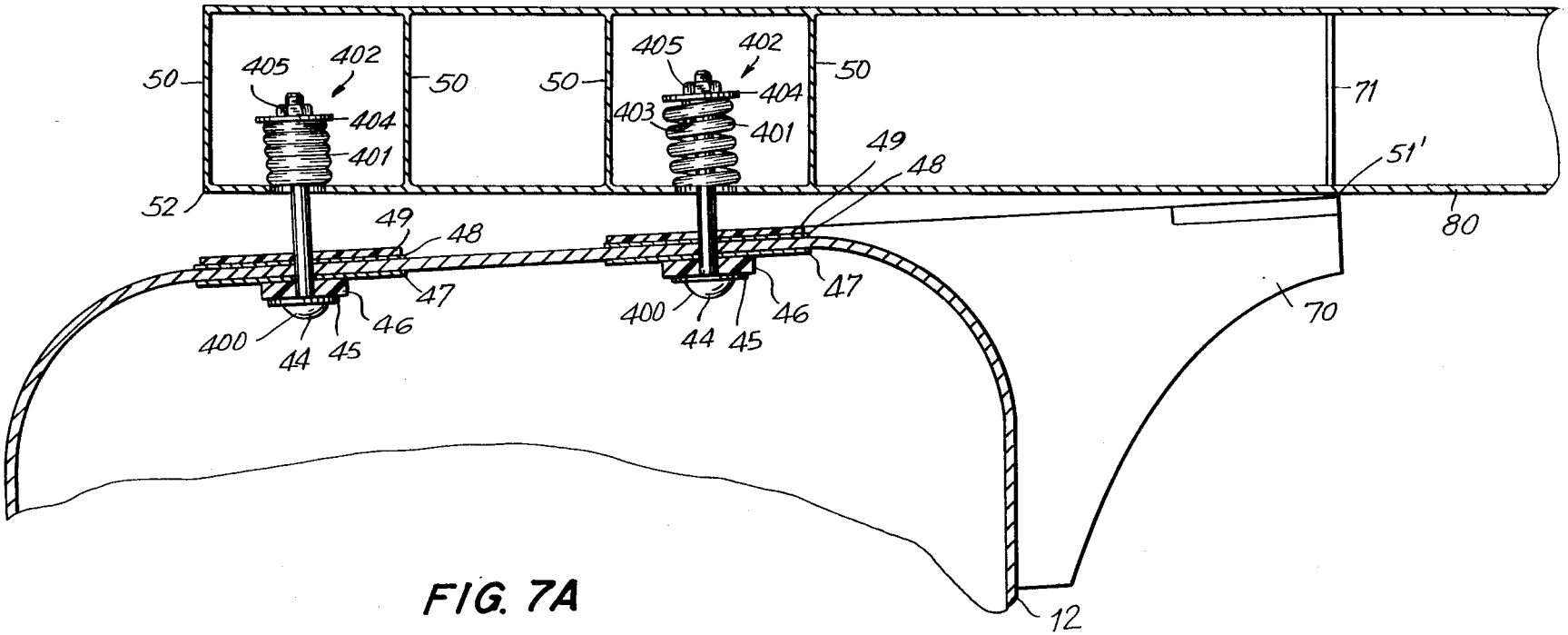
FIG. 7A is an elevational view, partly in section, of the connection of FIG. 7 with the springs in their compressed condition.

In FIGS. 7, 7A and 8, leverage element 70 has been added to hull 12. As seen in FIG. 3, elements 70 can be added to both hulls 11, 12, each facing inward toward the other hull. The leverage elements are attached only to the hull. By moving the pivot point from 51 to 51' using leverage element 70, the maximum tolerable force is increased in proportion to the length of leverage element 70. A gusset 71 is provided on crossbeam 80 at pivot point 51' to prevent buckling of crossbeam 80 at that point. However, as discussed above in connection with the selection of the stiffness of springs 401, increasing the maximum tolerable force also increases the minimum force on the hull to which springs 401 will respond. If the minimum force is made too high, the waves may damage hull 12 before springs 401 begin to absorb their force. A balance must therefore be struck in determining the length of leverage element 70.

The width of element 70 is preferably less than that of a crossbeam, and the element 70 is preferably centered under a crossbeam. If more than one element 70 is used on a single hull, each should also preferably be centered under a crossbeam. It is also advisable to provide a watertight bulkhead 85 under each element 70. Bulkhead 85 acts as a brace against a large force tending to cause hull 12 to buckle under element 70, and if buckling occurs, hull 12 will be less likely to fill completely with water.

Figure 9:
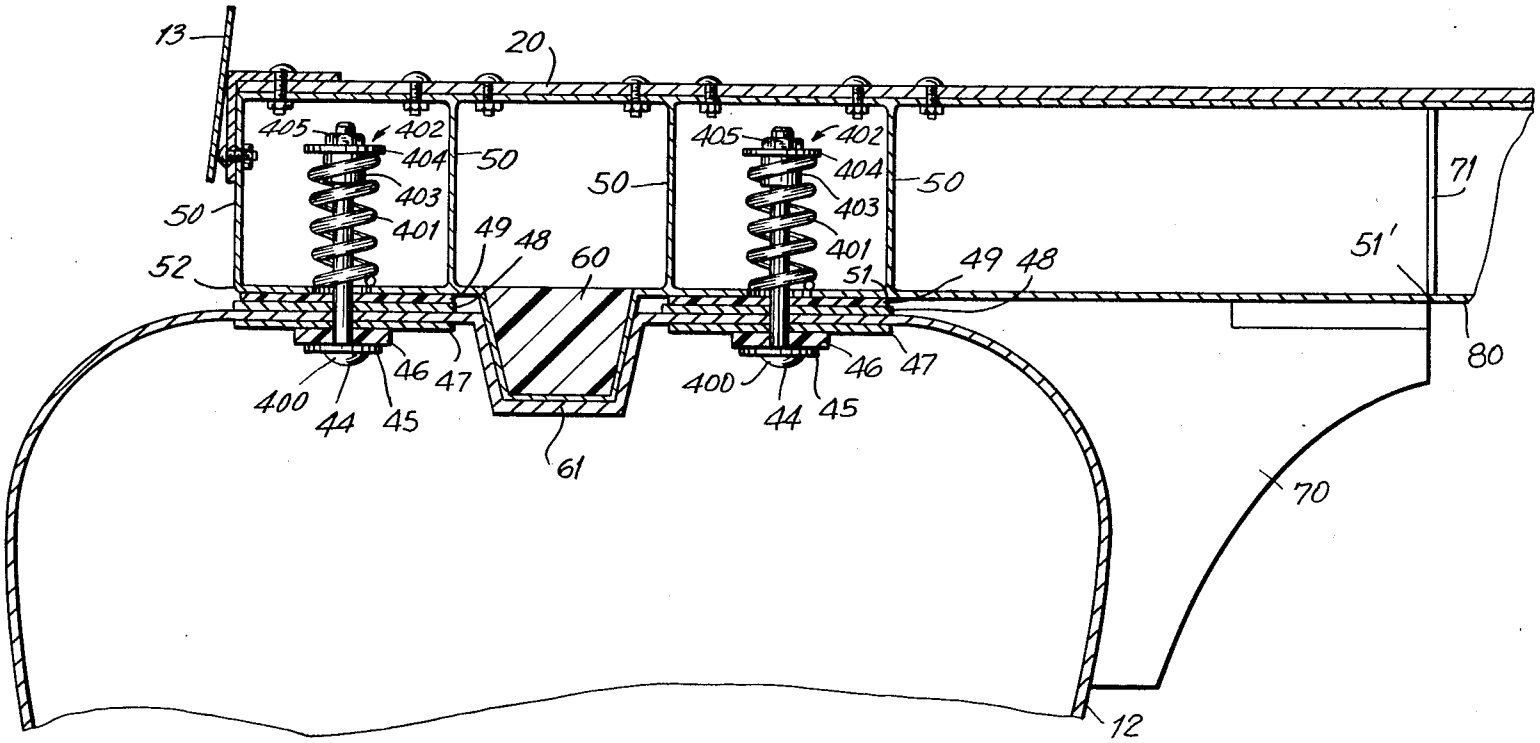
FIG. 9 is an elevational view, partly in section, of a third alternative embodiment of the connection of FIG. 5.
Figure 9A:
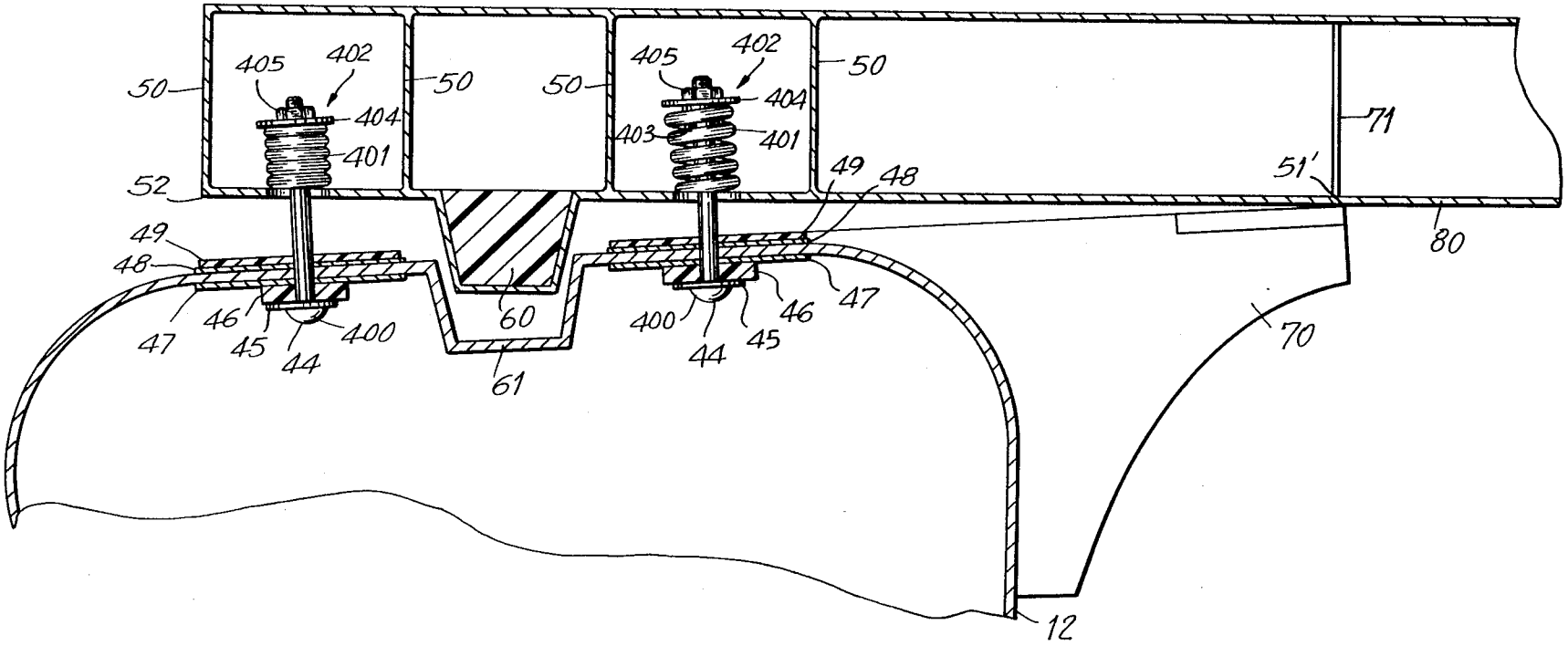
FIG. 9A is an elevational view, partly in section, of the connection of FIG. 9 with the springs in their compressed condition.

In the most preferred embodiment of vessel 10, shown in FIGS. 9 and 9A, projection 60 and leverage element 70 are both used.

Figure 10:
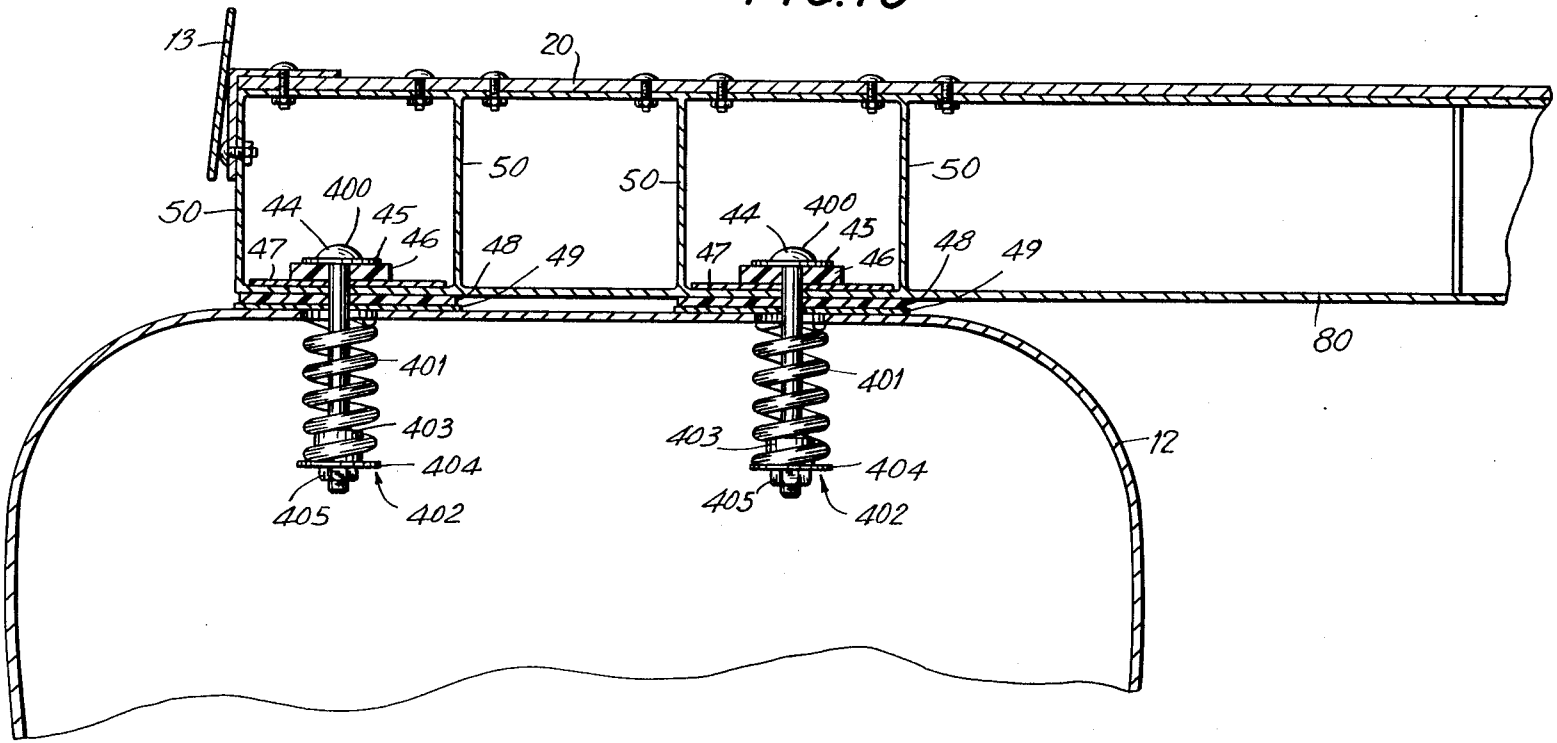
FIG. 10 is an elevational view, partly in section, of a fourth alternative embodiment of the connection of FIG. 5.

FIG. 10 shows an alternative embodiment of the invention in which bolt 44 passes from crossbeam 80 downward through hull 12. The arrangement of washers, plates and cushions, and the principle of operation, are essentially the same, but elongated holes 84 are in hull 12 rather than crossbeams 80–83.

Thus, a multiple-hulled marine vessel is provided which resists torsional and horizontal forces tending to separate the hulls from the cabin platform. One skilled in the art will recognize that the inventive principles disclosed herein can be practiced by other than the embodiments shown, which are presented for the purposes of illustration rather than limitation, and the present invention is limited only by the claims which follow.

What is claimed is:

1. A catamaran comprising a pair of similar hulls having parallel longitudinal axes and being spaced apart side by side in a direction perpendicular to said longitudinal axes;

a plurality of spaced apart beams lying across said hulls in a direction perpendicular to the longitudinal axes of the hulls, each of said beams having a generally flat horizontal lower flange resting upon and in direct contact with each of said hulls;

each of said hulls and said flanges containing a plurality of openings, each opening in a hull being axially aligned with and juxtapositioned beneath a corresponding opening in one of the flanges;

a plurality of bolts, each bolt having a head too large to pass through the aligned openings in the hulls and flanges, the shank of said bolt passing vertically through said aligned openings, said shank having an end opposite said head; and a plurality of coil springs having opposite ends, each spring encircling the shank of one of the bolts passing through said aligned openings and having one of said spring fastened to the end of the bolt opposite the bolt's head, whereby the coil springs are in their non-tensioned state when said hulls and beams are in their nominal positions with the beams resting upon and in contact with said hulls, and at least one of said springs associated with each hull is compressed in response to forces tending to separate the respective hull from its associated beam.

2. The catamaran of claim 1 wherein at least one of the beams includes two openings above each of the two hulls, corresponding aligned openings in each of said hulls, and the bolts and springs associated with each of said pairs of aligned openings.

3. The catamaran of claim 1 further comprising a leverage element extending from each of said hulls toward the other hull beneath one of said beams, the end of each leverage element remote from the hull to which it is connected being in contact with the underside of said beam, whereby said leverage elements increase the force on said catamaran necessary to compress said coil springs.

4. A catamaran comprising a pair of similar hulls having parallel longitudinal axes and being spaced aparat side by side in a direction perpendicular to said longitudinal axes;

a plurality of spaced apart beams lying across said hulls in a direction perpendicular to the longitudinal axed of the hulls, each of said beams having a generally flat horizontal lower flange resting upon and in direct contact with each of said hulls;

each of said hulls and said flanges containing a plurality of openings, each opening in a hull being axially aligned with and juxtapositioned beneath a corresponding opening in one of the flanges;

at least one of said beams including a pair of projections, each projection depending from the underside of said beam toward one of said hulls;

a recess in the surface of each of said hulls juxtapositioned to receive one of said projections, said recess having approximately the same dimensions as said projection, said projections engaging said recesses to prevent substantial horizontal relative displacement between said hulls and said beam;

a plurality of bolts, each bolt having a head too large to pass through the aligned openings in the hulls and flanges, the shank of said bolt passing vertically through said aligned openings, said shank having an end opposite said head; and a plurality of coil springs having opposite ends, each spring encircling the shank of one of the bolts passing through said aligned openings and having one end of said spring fastened to the end of the bolt opposite the bolt's head, whereby the coil springs are in their non-tensioned state when said hulls and beams are in their nominal positions with the beams resting upon and in contact with said hulls, and at least one of said springs associated with each hull is compressed in response to forces tending to separate the respective hulls from its associated beam.

* * * * *